US010378110B2

(12) United States Patent
Damiani et al.

(10) Patent No.: US 10,378,110 B2
(45) Date of Patent: Aug. 13, 2019

(54) PAINTING PRE-TREATMENT PROCESSES WITH LOW ENVIRONMENTS IMPACT, AS AN ALTERNATIVE TO CONVENTIONAL PHOSPHATING TREATMENTS

(75) Inventors: Matteo Damiani, Trecate (IT); Claudio Caldana, Cinisello Balsamo (IT)

(73) Assignee: Quaker Chemical S.r.l., Milan (IT)

( * ) Notice: Subject to any disclaimer, the term of this patent is extended or adjusted under 35 U.S.C. 154(b) by 674 days.

(21) Appl. No.: 13/574,755

(22) PCT Filed: Jan. 18, 2011
(Under 37 CFR 1.47)

(86) PCT No.: PCT/EP2011/050583

§ 371 (c)(1),
(2), (4) Date: Feb. 15, 2013

(87) PCT Pub. No.: WO2011/092079

PCT Pub. Date: Aug. 4, 2011

(65) Prior Publication Data

US 2013/0142941 A1 Jun. 6, 2013

(30) Foreign Application Priority Data

Jan. 26, 2010 (IT) ..... MI2010A0094

(51) Int. Cl.

| | |
|---|---|
| ***C23C 22/44*** | (2006.01) |
| ***C23C 18/18*** | (2006.01) |
| ***C23C 22/73*** | (2006.01) |
| ***C23C 22/83*** | (2006.01) |

(52) U.S. Cl.
CPC ..... *C23C 18/1837* (2013.01); *C23C 22/44* (2013.01); *C23C 22/73* (2013.01); *C23C 22/83* (2013.01)

(58) Field of Classification Search
CPC ..... C23C 22/07; C23C 22/08; C23C 22/36; C23C 22/361; C23C 22/42; C23C 22/44
See application file for complete search history.

(56) References Cited

U.S. PATENT DOCUMENTS

| | | | | |
|---|---|---|---|---|
| 3,129,121 | A * | 4/1964 | Rodzewich | C23C 22/10 148/260 |
| 3,723,334 | A * | 3/1973 | Maurer | 252/181 |
| 4,775,427 | A * | 10/1988 | Portz et al. | 148/254 |
| 4,865,653 | A * | 9/1989 | Kramer | C23C 22/12 148/254 |
| 6,706,123 | B2 * | 3/2004 | Fristad et al. | 148/259 |
| 6,720,032 | B1 * | 4/2004 | Kuhm | C23C 22/12 148/251 |
| 2005/0145303 | A1 * | 7/2005 | Schenzle | C23C 22/365 148/251 |
| 2006/0147735 | A1 * | 7/2006 | Matsukawa et al. | 428/469 |
| 2006/0278307 | A1 * | 12/2006 | Nitschke et al. | 148/260 |
| 2007/0068602 | A1 * | 3/2007 | Pemberton et al. | 148/247 |
| 2007/0099022 | A1 | 5/2007 | Matzdorf et al. | |
| 2008/0254315 | A1 * | 10/2008 | Sato | C23C 22/40 428/649 |
| 2008/0286470 | A1 * | 11/2008 | Matsukawa et al. | 427/327 |
| 2009/0274926 | A1 | 11/2009 | Okai et al. | |
| 2010/0293788 | A1 | 11/2010 | Schoenherr et al. | |

FOREIGN PATENT DOCUMENTS

| | | |
|---|---|---|
| DE | 10 2007 057 185 | 5/2009 |
| JP | 56-105485 | 8/1981 |
| JP | 2003-038983 | 12/2003 |
| WO | 98/20186 | 5/1998 |
| WO | 03/100130 | 12/2003 |

OTHER PUBLICATIONS

International Search Report from International Application No. PCT/EP2011/050583.
European Examination Report dated May 19, 2016 for co-pending European Application No. 11 701 776.4.

* cited by examiner

*Primary Examiner* — David P Turocy
(74) *Attorney, Agent, or Firm* — Morgan, Lewis & Bockius LLP

(57) ABSTRACT

Disclosed is a process alternative to the zinc phosphating and phosphodegreasing processes, which comprises: >Zinc phosphating replacement a. a step of alkaline degreasing of the article to be phosphated; b. a first wash with tap water; c. a second wash with demineralized water; d. a conversion treatment in a bath containing zirconium salts, phosphates, fluoride complexes, ammonia, at least one corrosion inhibitor, at least one process accelerator, at least one sequestering agent, a reaction sludge thickening system, and optionally, titanium and vanadium compounds; e. a final wash before treatment of the article in the oven. >Phosphodegreasing process replacement a. a conversion treatment in a bath containing zirconium salts, phosphates, fluoride complexes, ammonia, at least one corrosion inhibitor, at least one process accelerator, at least one sequestering agent, at least one surfactant, a reaction sludge thickening system, and optionally, titanium and vanadium compounds; b. a wash with tap water; c. a wash with demineralized water before treatment of the article in the oven.

24 Claims, No Drawings

PAINTING PRE-TREATMENT PROCESSES WITH LOW ENVIRONMENTS IMPACT, AS AN ALTERNATIVE TO CONVENTIONAL PHOSPHATING TREATMENTS

CROSS-REFERENCE TO RELATED APPLICATION

The present application claims priority to International Application No. PCT/EP2011/050583, filed on 18 Jan. 2011, which claims priority to Italian Patent Application No. MI2010A000094, filed on 26 Jan. 2010, the contents of which are hereby incorporated by reference in their entirety.

FIELD OF INVENTION

The invention relates to phosphating treatment processes applicable for various purposes, such as anticorrosion protection prior to oiling or waxing, anticorrosion protection prior to painting (vehicle bodywork, household appliances and the like), reducing stresses in the cold deformation of semi-finished products (drawing of tubes, wires, extrusions and the like), reduction of friction between sliding surfaces (manganese phosphating), and electrical insulation.

Whatever the purpose for which it is used, the process comprises various steps, and the reactions that take place comprise two main steps.

The reaction begins with an acid attack on iron, which passes into solution in ion form, by means of an electrochemical mechanism comprising the anode reaction of iron oxidation and a simultaneous cathode reaction of development of molecular hydrogen. As a result of this attack the concentration of hydrogen ions falls (the pH increases) in the diffusion boundary layer (a few microns) close to the microcathodic zones, because the more the pH value increases, the lower the solubility of the phosphates becomes. The least soluble phosphates begin to a precipitate in these zones, and small crystals of zinc phosphate (or iron, zinc-iron, zinc-calcium, or the like) form after only a few seconds (less than 10). The initial nuclei then enlarge, but doesn't increase in number.

PRIOR ART

Phosphating is the most widespread pre-treatment used on metals prior to painting. Although it is specifically designed for iron, carbon steel and galvanised surfaces, it can also be successfully applied to aluminium, especially in cases where that metal needs to be treated together with others in the same factory.

Before a metal is painted, pre-treatment is nearly always needed to eliminate protective grease and oil, lubricants of various kinds, oxides and calamine, dust, unconsolidated materials and the like. Paint cannot always be applied if the surface of the metal is contaminated by alkaline residues originating, for example, from alkaline degreasing which is not thoroughly rinsed.

In the case of iron surfaces, it is also necessary to ensure that, after such cleaning, the surface does not reoxidise in the short time between pre-treatment and painting. If a cleaning solvent is used, the problem of reoxidation does not arise; however, it can occur when decontamination is performed in aqueous phase.

For the purpose of pre-treatment, the properties which a paint must possess after application to a given substrate can be divided into two classes:

- mechanical, associated with adherence between the paint and the surface, even in the event of deformation of the basic metal (adhesion, bending, drawing, and impact resistance);
- anticorrosive, associated with resistance to the propagation of underfilm corrosion.

In practice, therefore, pre-treatment should not worsen (and if possible should improve) the mechanical properties of the metal, and should improve its anticorrosive properties as much as possible: phosphating is ideal for both purposes.

As regards mechanical properties, the coatings must be as thin as possible, because high coating weights can cause the film of paint to flake off under stress, such as bending or drawing of the metal substrate.

There is no correlation between corrosion resistance and coating weight; rather, anticorrosion efficacy is correlated with porosity and the content of metals other than zinc (iron, manganese and nickel) in the coating.

As regards porosity, it seems logical that the larger the metal surface exposed to the coat of paint (which is also porous), the more easily corrosion can occur.

The iron, manganese and nickel content of the coating also affects its solubility in alkalis: zinc phosphate, an amphoteric metal, is readily soluble in caustic soda, whereas iron, manganese and nickel phosphates are insoluble, or less and more slowly soluble therein.

In industrial practice, two main types of process have been in widespread use for some time:

1. crystalline phosphating, constituted by zinc phosphates, used only when the painted product will later be subjected to highly corrosive environments, mainly in the automobile and household appliance fields.
2. Amorphous phosphating constituted by iron phosphates, also called alkaline phosphating due to the composition of the solution (based on acid alkaline phosphates) or phosphodegreasing, in view of the dual action of the solution (phosphating and grease-removal); the level of corrosion protection offered, though less than that obtained with crystalline phosphating, is still very good, and the performance is generally highly acceptable, unless the products are designed for use in particularly corrosive environments.

The choice between the two pre-treatments is a compromise between quality and economic and environmental costs: in industrial practice, crystalline phosphating is mainly used in the automobile and household appliance industries; the other ferrous, galvanised and, to a lesser extent, aluminium products are pre-treated before painting by amorphous phosphating. An important characteristic of this latter process is the possibility of adding a suitable mixture of surfactants to the phosphating product, so that the metal surface is cleaned and phosphated in a single treatment. Surfactants facilitate the removal of any oils and fats which may be present, thus preparing the metal surface for contact with the phosphating solution. Their choice must take account of the type of application proposed: they must not produce foam if they are to be used in a spray system, whereas this limitation does not apply to lance or immersion applications.

The chemical mechanism is the same for both types of process, as described above.

All modern zinc phosphating baths consist of zinc acid phosphate and accelerators (oxidising agents), plus various additives; due to the action of the accelerators, and the effect of depolarising metals, the molecular hydrogen that forms at the cathode is immediately reoxidised to ion, thus restoring the local acidity of the bath and guaranteeing the duration of the process.

An amorphous phosphating bath generally contains monosodium phosphate, free phosphoric acid in small quantities to maintain the pH in the required range of values, surfactants, accelerators and additives. The pH of the baths is much higher than that typical of crystalline phosphating, because the precipitation of neutral ferrous phosphate, which takes place at the expense of the phosphoric ion of the solution and of the iron originating from the metal surface, requires mildly acid conditions.

In amorphous phosphating, especially in the case of spray or lance application, the accelerant plays a slightly different role from that of "oxidiser" as in the case of crystalline phosphating. In these applications, the oxidation of the iron from bivalent to trivalent still takes place through the oxygen in the air, and the accelerant mainly acts as catalyst towards the coating formation reaction; in other words, its operating mechanism does not necessarily depend directly on oxidising power.

PRIOR ART

Patents relating to the field of the invention include the following:

WO 98/20186 A1

- The patent discloses a conversion bath able to treat a variety of different metals, containing fluoride complexes (preferably zirconium and/or titanium fluoride), free fluorides, phosphates, citric acid (used as chelating agent), hydroxylamine, oxidising agents selected from nitrogen aromatic organic compounds (paranitrobenzenesulphonic acid and/or its sodium salt) and soluble salts of molybdic acid, one or more surfactants, a hydrotropic agent and an antifoaming agent.
- The patent makes no reference to inhibitors designed to prevent the appearance of oxidative phenomena during accidental or intentional stoppages of the production line; both hydroxylamine and molybdic acid are indeed described as process accelerators, not as corrosion inhibitors, a function for which neither of the two compounds is designed.
- No mention is made of specific systems able to limit the quantity of sludge: the only reference is to citric acid, used as sequestering agent and compared with gluconic acid.
- As regards the colour of the surface coating obtained, the patent states that "the conversion coating layer produced by this embodiment is often difficult to detect visually . . . ." (page 5, line 24).

WO 03/100130 A2

- This patent also discloses a conversion bath able to treat a variety of different metals, containing fluoride complexes (preferably zirconium and/or titanium fluorides), free fluorides and phosphates. The novel elements introduced are, on the one hand, tannin (or tannic acid) and, on the other, one or more silanes, selected from a wide range. A disaccharide can be considered in order to increase the working life of the bath, but it is only used in this patent for its reducing action [0034].
- No mention is made in the patent of the need for the presence of specific inhibitors, sequestering agents or systems able to reduce the reaction sludge; this omission is confirmed by the fact that no component of the bath is able to perform any of said functions. Equally, no mention is made of the problem of the possible colouring of the surface conversion film obtained.

DE 10 2007 057185 A1

- The patent refers to a chromium-free pre-painting process for ferrous surfaces, specifically designed for radiators, based on complex zirconium and/or titanium fluorides and phosphate ions in precise mixing ratios.
- This patent makes no mention of a need for specific inhibitors, sequestering agents or systems able to reduce the reaction sludge; this omission is confirmed by the fact that none of the components of the bath can perform any of these functions (the polyvinylpyrrolidone referred to is neither a corrosion inhibitor nor a sequestering agent).
- Equally, no mention is made of the problem of the possible colouring of the surface conversion film obtained.

US 2009/0274926 A1

- This patent relates to a chromium-free process designed only for the coil coating sector and galvanised steel. It discloses a pre-treatment bath consisting of resinous compounds with a particular chemical structure, cationic urethane resins, vanadium and zirconium compounds, phosphates and mineral acid (hydrofluoric, acetic, nitric or sulphuric acid).
- No reference is made to the possible colouring of the conversion coating, the problem of reaction sludge and its containment, or the need for specific inhibitors and specific sequestering agents.

US 2007/068602 A1

- This patent discloses a bath designed to be used for surface conversion treatment of ferrous material only, which has a low phosphate content and contains zirconium, vanadium and fluorides.
- Once again, no reference is made to the possible colouring of the conversion coating, the problem of reaction sludge and its containment, or the need for specific inhibitors (vanadium compounds certainly cannot be described as such).
- The only reference to the presence of chelating and/or sequestering agents is in paragraph [0019], which expressly states: "these components include chelating agents to condition the aqueous solution", without going into more specific details about their function; the two examples given refer to pentasodium triethylenetriamine pentaacetate and EDTA respectively.

DESCRIPTION OF THE INVENTION

The invention relates to a phosphating process for multimetal pre-painting surface treatments which, with different application procedures, provides an alternative to traditional zinc phosphating processes and phosphodegreasing processes.

The process of the invention offers, for both applications:

- Low environmental impact, due to the elimination of heavy metals;
- Simplification of the process in engineering terms, due to the drastic reduction in the number of steps required;
- Energy saving, in view of the possibility of working at lower operating temperatures;
- A reduction in the number of products involved in the treatment;
- A drastic reduction, estimated at a minimum of 90%, in the quantity of reaction sludge, which is very friable, and consequently easier to remove;

A reduction in deposits/encrustations in the feed pipes and heat exchangers;

The formation of a coloured conversion layer which gives the operatives on the production line an immediate idea in real time of the operation of the line, with no need to wait for the results of destructive tests.

This aspect appears particularly important, and constitutes an important innovation compared with other products alternative to the conventional zinc phosphating and phosphodegreasing products currently used, paving the way for their industrial use. While conventional products, due to the colour acquired by the conversion layer obtained, immediately show whether the quality of the coating is good or not, the alternative products applied to date on industrial production lines give a colourless or slightly yellowish coating, the colour of which can easily be mistaken for rust, which means that it is very difficult, if not impossible, to evaluate the quality correctly.

The process according to the invention therefore produces a significant reduction in operating costs, greater operational safety, and is more environment-friendly.

The process can be applied, by spray or immersion, to all types of substrate, such as cold-rolled steel (CRS), electrogalvanised steel (EG), hot-dip galvanised steel (HDG) or aluminium (AL), and is compatible with the subsequent application of all the main painting processes now known (electrophoresis, powder paints and liquid paints).

The mechanical performance and corrosion resistance of these products are at least comparable to those obtained with conventional cycles.

In a first embodiment thereof, the invention provides a process that replaces zinc phosphating, comprising:

a) a step of alkaline degreasing of the article to be phosphated;

b) a first wash with tap water;

c) a second wash with demineralised water;

d) a conversion treatment in a bath containing zirconium salts, phosphates, fluoride complexes, ammonia, at least one corrosion inhibitor, at least one process accelerator, at least one sequestering agent, and optionally, titanium and vanadium compounds;

e) a final wash before treatment of the article in the oven.

Degreasing (step a) serves to eliminate all trace of oils, fats, cleaning paste, oxides and any other impurities from the coil surface, in order to leave a perfectly clean metal surface ready for subsequent treatments.

Normally, said degreasing is performed with liquid products in aqueous solution at an alkaline pH (10-14). The use concentration is between 1% and 10%, and the temperature of the working bath between 50° C. and 70° C., for a treatment time of between 30 and 120 seconds.

The degreasing bath typically contains 2 to 20 g/l of KOH or NaOH, 2 to 20 g/l of $P_2O_5$, 200 to 3000 ppm of surfactants, and 1 to 10 g/l of sequestering additives.

$P_2O_5$ is present in the form of sodium or potassium orthophosphates (monosodium, disodium or trisodium phosphate) or polyphosphates (tripolyphosphate or neutral pyrophosphate).

The surfactants most commonly used are selected from ethoxylated and/or ethoxy-propoxylated fatty alcohols with C9-C11, C12-C13 or C12-C18 alcohol chain, with different degrees of ethoxy-propoxylation.

The sequestering additives are preferably selected from nitriloacetic acid, sodium gluconate, gluconic acid, ethylenediaminetetraacetic acid disodium, ethylenediaminetetraacetic acid trisodium, phosphonates, acrylates and polyacrylates.

The wash with tap water (step b) serves to eliminate all trace of the preceding step; the temperature is normally between 30° C. and 60° C., with times ranging between 15 and 60 seconds.

Washing with demineralised water (step c) completes the action of the preceding step, and the operating conditions are the same; the temperature ranges between 30° C. and 60° C. for times of 15 to 60 secs.

The conversion treatment (step d) is the characteristic feature of the invention. It is usually performed at a temperature of between 15° C. and 50° C., for times ranging between 20 a 120 seconds, depending on the speed of the line, the type of application (spray or immersion) and the quality/reactivity of the metal. The treatment is normally performed with the bath described above, based on zirconium salts and phosphates with a pH of between 4 and 5, used at concentrations of between 10 and 30 g/1.

The zirconium salts are usually present in concentrations of 100 to 5000 mg/l, and are preferably selected from fluorozirconic acid, ammonium zirconium carbonate and potassium fluorozirconate.

The phosphates, typically present in concentrations of 10-500 mg/l, are ammonium orthophosphates (monosodium, disodium or trisodium phosphate) or polyphosphates (tripolyphosphate or neutral pyrophosphate).

The fluoride complexes are present in concentrations of 100-10000 mg/l, while ammonia is present in concentrations of 100-1000 ppm.

The titanium compounds comprise, for example, fluorotitanic acid, titanium oxalate, titanium oxide and potassium fluorotitanate, and can be present in concentrations of 100-5000 mg/l.

Other metals, such as vanadium, molybdenum and antimony, can be present in acid or salified form in concentrations of between 10 and 10000 mg/l.

The corrosion inhibitor, present in concentrations of 100-500 ppm, can be a more or less branched amine, an alkine derivative or a thiourea derivative, and has the basic function of preventing the appearance of oxidative phenomena during accidental or intentional stoppages of the treatment line.

The process accelerator is typically a donor compound of inorganic $NO_3$, such as ammonium nitrate, or nitrogen organic compounds such as nitroguanidine or benzene derivatives, used alone or mixed together, in concentrations of 100-1500 ppm.

The system that limits the quantity of sludge and makes it friable, and therefore easily removable, consists of a suitably balanced combination of a polysaccharide and a glycol.

The sequestering agents are selected from those specified above for the degreasing bath, at concentrations of 10-5000 ppm.

The morphology of the phosphate coating obtained, mostly consisting of zirconium and/or titanium phosphates, is compact, uniform and highly insoluble. Depending on the type of application (spray or immersion) and the type of metal, the thickness of the phosphate coating layer can range between 50 and 200 nm, and the colour of the layer can vary from iridescent yellow to dark red or blue.

In a second embodiment thereof, the invention provides a process that replaces phosphodegreasing, comprising:

a) a conversion treatment in a bath containing zirconium salts, phosphates, fluoride complexes, ammonia, at least one corrosion inhibitor, at least one process accelerator, at least one sequestering agent, at least one surfactant, and optionally, titanium and vanadium compounds;

b) a wash with tap water;

c) a wash with demineralised water before treatment of the article in the oven.

Step a) is similar to step d) described above, in terms of the components and their concentrations, with the sole difference that the conversion bath also contains at least one surfactant able to eliminate traces of oils, fats, cleaning paste, oxides and all other impurities from the surface of the material. The same surfactants as described above for the degreasing step can conveniently be used.

Similarly, washing steps b) and c) are performed under the same conditions as for the corresponding washing steps of the zinc phosphating replacement process described above.

The invention is described in greater detail in the examples below.

Example 1—Replacement of Zinc Phosphating Processes

| Element | Concentration |
|---|---|
| **Degreasing** | |
| KOH | 4 g/l |
| $P_2O_5$ from neutral potassium pyrophosphate | 5 g/l |
| Surfactants with chain C9-C11 + 5 and 6 moles of OE | 500 ppm |
| Sodium gluconate | 3 g/l |
| Use concentration of product | 3-5% |
| Temperature | 50-60° C. |
| Treatment time | 30 sec. |
| Spray pressure | 2 bars |
| **First wash** | |
| Continuously renewed tap water | — |
| Temperature | 30° C. |
| Treatment time | 30 sec. |
| Spray pressure | 2 bars |
| **Second wash** | |
| Continuously renewed demineralised water | — |
| Temperature | 30° C. |
| Treatment time | 30 sec. |
| Spray pressure | 2 bars |
| **Conversion treatment** | |
| Zr (from fluorozirconic acid) | 500 mg/l |
| $P_2O_5$ (from dibasic ammonium phosphate) | 25 mg/l |
| $NH_3$ | 50 ppm |
| Total fluorides | 200 ppm |
| Nitrogen organic accelerator | 750 ppm |
| Hexamethylenetetramine (inhibitor) | 300 ppm |
| Polysaccharide/glycol mixture | 500 ppm |
| Phosphonate | 1000 ppm |
| Vanadium salts | 10 ppm |
| Use concentration of immersion product | 3% |
| Use concentration of spray product | 1% |
| Temperature | Ambient |
| Spray treatment time | 20 sec. |
| Immersion treatment time | 60 sec. |
| pH | 4.5 |

Example 2—Replacement of Phosphodegreasing Processes

| Element | Concentration |
|---|---|
| **Conversion treatment** | |
| Zr (from fluorozirconic acid) | 500 mg/l |
| $P_2O_5$ (from dibasic ammonium phosphate) | 25 mg/l |
| $NH_3$ | 50 ppm |
| Total fluorides | 200 ppm |
| Nitrogen organic accelerator | 750 ppm |
| Hexamethylenetetramine | 300 ppm |
| Phosphonate | 1000 ppm |
| Surfactants with chain C9-C11 + 4-5 moles of OE/5-4 moles of OP | 300 ppm |
| Polysaccharide/glycol mixture | 500 ppm |
| Vanadium salts | 10 ppm |
| Use concentration of spray product | 1 to 3% |
| Temperature | 30 to 50° C. |
| Treatment time | 120 sec. |
| pH | 4.5 |
| **First wash** | |
| Continuously renewed tap water | — |
| Temperature | 30° C. |
| Treatment time | 30 sec. |
| Spray pressure | 2 bars |
| **Second wash** | |
| Continuously renewed demineralised water | — |
| Temperature | 30° C. |
| Treatment time | 30 sec. |
| Spray pressure | 2 bars |

Example 3—Laboratory Tests and Results

The laboratory tests were conducted so as to compare the results obtained with those of conventional cycles.

Cold-rolled steel plates (CRS), electrogalvanised steel (EG), hot-dip galvanised steel (HDG) and aluminium (AL) were tested; after the cycles, they were painted with 2 types of paint for both cases of pre-treatment, according to the normal conditions of industrial application.

The treated and painted plates were subjected to corrosion-resistance tests in a salt spray (fog) chamber, in accordance with Standard ASTM B 117. Panels on which a deep cross-cut was made down to the basic metal, with protected edges, were inspected for the appearance of the first signs of corrosion.

For convenience, Table 1 shows the ways in which the various cycles tested were distinguished. The results obtained are expressed as hours of exposure in the salt spray chamber until the appearance of the first signs of oxidation, such as sub-corrosion or flaking of the paint at a distance of >1 mm from the cut.

TABLE 1

| PROCESS | SUBSTRATE | PAINT | CODE | RESULTS |
|---|---|---|---|---|
| Zinc phosphating conventional spray process | CRS | 1 | ZSTC1 | 700 |
| | | 2 | ZSTC2 | 850 |
| | EG | 1 | ZSTE1 | 1000 |
| | | 2 | ZSTE2 | 1000 |
| | HDG | 1 | ZSTH1 | 800 |
| | | 2 | ZSTH2 | 800 |
| | AL | 1 | ZSTA1 | 1000 |
| | | 2 | ZSTA2 | 1000 |
| Process alternative to conventional zinc phosphating spray process | CRS | 1 | ZSIC1 | 700 |
| | | 2 | ZSIC2 | 900 |
| | EG | 1 | ZSIE1 | 1000 |
| | | 2 | ZSIE2 | 1000 |
| | HDG | 1 | ZSIH1 | 800 |
| | | 2 | ZSIH2 | 800 |
| | AL | 1 | ZSIA1 | 1000 |
| | | 2 | ZSIA2 | 1000 |
| Zinc phosphating conventional immersion | CRS | 1 | ZDTC1 | 700 |
| | | 2 | ZDTC2 | 850 |

TABLE 1-continued

| PROCESS | SUBSTRATE | PAINT | CODE | RESULTS |
|---|---|---|---|---|
| process | EG | 1 | ZDTE1 | 1000 |
| | | 2 | ZDTE2 | 1000 |
| | HDG | 1 | ZDTH1 | 800 |
| | | 2 | ZDTH2 | 800 |
| | AL | 1 | ZDTA1 | 1000 |
| | | 2 | ZDTA2 | 1000 |
| Process alternative to conventional zinc phosphating immersion process | CRS | 1 | ZSIC1 | 700 |
| | | 2 | ZSIC2 | 900 |
| | EG | 1 | ZSIE1 | 1000 |
| | | 2 | ZSIE2 | 1000 |
| | HDG | 1 | ZSIH1 | 800 |
| | | 2 | ZSIH2 | 800 |
| | AL | 1 | ZSIA1 | 1000 |
| | | 2 | ZSIA2 | 1000 |
| Phosphodegreasing conventional spray process | CRS | 1 | FTC1 | 500 |
| | | 2 | FTC2 | 600 |
| | EG | 1 | FTE1 | 600 |
| | | 2 | FTE2 | 600 |
| | HDG | 1 | FTH1 | 700 |
| | | 2 | FTH2 | 750 |
| | AL | 1 | FTA1 | 600 |
| | | 2 | FTA2 | 600 |
| Process alternative to conventional zinc phosphating spray process | CRS | 1 | FIC1 | 700 |
| | | 2 | FIC2 | 900 |
| | EG | 1 | FIE1 | 800 |
| | | 2 | FIE2 | 800 |
| | HDG | 1 | FIH1 | 800 |
| | | 2 | FIH2 | 800 |
| | AL | 1 | FIA1 | 600 |
| | | 2 | FIA2 | 600 |

In view of the results obtained, the two alternative processes were further tested to evaluate the quantity of sludge formed, which was compared, once again, with that obtained in the corresponding conventional processes. The results are shown in Table 2 below.

TABLE 2

| PROCESS | QUANTITY OF SLUDGE Values not absolute, but relative |
|---|---|
| Conventional zinc phosphating | 100 |
| Process alternative to conventional zinc phosphating process | 15 |
| Conventional phosphodegreasing | 100 |
| Process alternative to conventional phosphodegreasing | 10 |

Evaluation of Technical and Economic Benefits

When the laboratory tests had been performed, and the very good results objectively evaluated, it was necessary to ensure that after industrialisation, the process would guarantee the same performance on the production line.

For this purpose, the product according to the invention was tested confidentially, for a period required to assess its real benefits, on two production lines in the field of household appliances; the first used traditional trication multimetal zinc phosphating, and the second used normal multimetal phosphodegreasing.

In all cases it was found that compared with conventional cycles:

- the quality of the treated products was equal, if not better;
- there is a real 90% reduction in sludge on the production line, which in both cases was removed very easily, with no problems;
- the coloured conversion layer gives operators an idea of the operation of the line in real time, immediately showing whether the quality of the coating is good or poor, thus allowing an instant, correct quality assessment;
- the presence of the inhibitor prevented the appearance of oxidative phenomena on the surfaces of the article, even in the event of lengthy stoppages of the production lines;
- the process of the invention is simpler to perform, thus improving user safety.

The product is cheaper, guaranteeing lower electricity consumption, less maintenance of the tanks, and lower logistical and waste water disposal costs.

The invention claimed is:

1. A process comprising:

applying a conversion treatment to a metal, the treatment comprising phosphates in a concentration of 10 mg/L to 500 mg/L, at least one corrosion inhibitor, at least one sequestering agent, a process accelerating agent, a reaction sludge thickening system, and zirconium salts;

wherein the process accelerating agent is selected from the group consisting of ammonium nitrate, nitroguanidine derivatives, benzene derivatives, and combinations thereof;

wherein the corrosion inhibitor is hexamethylenetetramine; and wherein a conversion layer is formed on the metal.

2. The process of claim 1, wherein the zirconium salts are selected from the group consisting of fluorozirconic acid, ammonium zirconium carbonate, potassium fluorozirconate, and combinations thereof.

3. The process of claim 2, wherein the conversion treatment is applied in a bath.

4. The process as claimed in claim 1, wherein the phosphates are selected from the group consisting of orthophosphates, ammonium polyphosphates, and combinations thereof.

5. The process according to claim 1, the treatment further comprising titanium compounds.

6. The process of claim 5, wherein the titanium compounds are selected from the group consisting of fluorotitanic acid, titanium oxalate, titanium oxide, potassium fluorotitanate; and combinations thereof.

7. The process according to claim 1, wherein the reaction sludge thickening system consists of a combination of a polysaccharide and a glycol.

8. The process of claim 1, the treatment further comprising fluoride complexes.

9. The process of claim 1, the treatment further comprising ammonia.

10. The process of claim 1, the treatment further comprising titanium compounds.

11. The process of claim 1, the treatment further comprising vanadium compounds.

12. The process of claim 1, further comprising alkaline degreasing the metal before applying the conversion treatment.

13. The process of claim 12, further comprising conducting a first wash of the metal after the alkaline degreasing.

14. The process of claim 13, wherein the first wash includes washing the metal with tap water.

15. The process of claim 13, further comprising conducting a second wash of the metal after the first wash.

16. The process of claim 15, wherein the second wash includes washing the metal with demineralised water.

17. The process of claim 1, further comprising conducting a final wash of the metal after applying the conversion treatment.

18. The process of claim 1, wherein the conversion treatment further comprises a real-time indicator.

19. The process of claim 1, wherein the conversion treatment further comprises an indicator that comprises a color of the conversion layer.

20. The process of claim 19, wherein the color ranges from iridescent yellow to dark red or blue.

21. The process of claim 1, wherein the conversion treatment is applied by a spray.

22. The process of claim 1, wherein the process is a zinc phosphating substitute process.

23. The process of claim 1, wherein the process is a phosphodegreasing process substitute.

24. A process which can be used as a substitute for phosphodegreasing processes, comprising:

a. applying a conversion treatment to a metal in a bath, the treatment containing zirconium salts, phosphates in a concentration of 10 mg/L to 500 mg/L, fluoride complexes, ammonia, at least one corrosion inhibitor, at least one process accelerating agent, at least one sequestering agent, at least one surfactant, a reaction sludge thickening system, and optionally, titanium and vanadium compounds, wherein a conversion layer is formed;

b. washing the metal with tap water; and, c. washing the metal with demineralised water before treating the metal in an oven, wherein the process accelerating agent is selected from the group consisting of ammonium nitrate, nitroguanidine derivatives, benzene derivatives, and combinations thereof;

wherein the corrosion inhibitor is hexamethylenetetramine; and wherein an indicator indicates the existence of the conversion layer.

* * * * *